US006694644B2

(12) United States Patent
Haupt

(10) Patent No.: US 6,694,644 B2
(45) Date of Patent: Feb. 24, 2004

(54) DEVICE FOR CLAMPING TOGETHER TWO PARTS OF A SPORTS ARTICLE

(75) Inventor: Olivier Haupt, Grenoble (FR)

(73) Assignee: Skis Rossignol S.A., Voiron (FR)

( * ) Notice: Subject to any disclaimer, the term of this patent is extended or adjusted under 35 U.S.C. 154(b) by 64 days.

(21) Appl. No.: 10/195,277

(22) Filed: Jul. 15, 2002

(65) Prior Publication Data

US 2003/0009918 A1 Jan. 16, 2003

(30) Foreign Application Priority Data

Jul. 16, 2001 (FR) ..... 01 09473

(51) Int. Cl.[7] ..... A43C 11/00

(52) U.S. Cl. ..... 36/50.5; 24/685 K; 24/705 K; 24/715 K

(58) Field of Search ..... 24/685 K, 68 R, 24/695 K, 705 K, 715 K; 36/50.1, 50.5

(56) References Cited

U.S. PATENT DOCUMENTS

| | | | | | |
|---|---|---|---|---|---|
| 3,662,435 | A | | 5/1972 | Allsop | 24/70 |
| 4,193,171 | A | * | 3/1980 | Lichowsky | 24/68 SK |
| 5,172,454 | A | * | 12/1992 | Martignago | 24/68 SK |
| 5,606,779 | A | | 3/1997 | Lu | 24/68 |
| 5,745,959 | A | | 5/1998 | Dodge | 24/68 |
| 5,852,852 | A | * | 12/1998 | Rigal | 24/68 R |
| 5,909,850 | A | * | 6/1999 | Cavasin et al. | 24/71 SK |
| 6,175,994 | B1 | * | 1/2001 | Nicoletti | 24/68 SK |
| 6,499,197 | B1 | * | 12/2002 | Huang | 24/68 CD |
| 2001/0013157 | A1 | * | 8/2001 | Giancarlo | 24/71 SK |

FOREIGN PATENT DOCUMENTS

| | | |
|---|---|---|
| EP | 0 857 436 A2 | 8/1998 |
| WO | WO 97/28859 | 8/1997 |

* cited by examiner

*Primary Examiner*—M. D. Patterson
(74) *Attorney, Agent, or Firm*—Heslin Rothenberg Farley & Mesiti, P.C.; Victor A. Cardona, Esq.

(57) ABSTRACT

Device for clamping together two parts of a sports article, including:

a rectilinear notched tongue (6), integral with a first part of the sports article;

a guide (30) integral with the second part of the sports article, said guide having two walls (33) between which said tongue (6) is able to slide;

a pawl (40) articulated on the guide (30), capable of interacting with the notched tongue (6) in order to immobilize it in position relative to the guide (30);

characterized in that it also includes a complementary piece (20) interacting with at least one part of the outer faces of the guide (30), and of which the portion located on the side with the opening of the guide (30) via which the tongue (6) is inserted includes two divergent walls (25, 26) which flare out and extend beyond the opening of the guide (30).

20 Claims, 6 Drawing Sheets

DEVICE FOR CLAMPING TOGETHER TWO PARTS OF A SPORTS ARTICLE

CROSS REFERENCE TO RELATED APPLICATIONS

This application claims priority from French patent application 00.09473, filed on Jul. 16, 2001, the entire disclosure of which is incorporated herein by reference.

1. Technical Field

The invention relates to the field of sports articles and, in particular, to gliding sports. It refers more particularly to a clamping device used on sports articles such as snowboard bindings, ski boots, roller skates or even harnesses. More specifically it relates to a particular geometry of certain mechanisms using notched tongues, the configuration of which facilitates use.

In the rest of the description, the invention is more particularly described in its application to a snowboard, but it may also be transposed to other, different sports articles which use clamping systems similar to those used on snowboard bindings.

2. Prior Art

Certain snowboard bindings, generally called "shell" bindings, have straps which pass over the foot so as to keep it pressed into the binding. These straps are generally adjustable in terms of their length so that they can be adapted to all boot configurations. One example of this type of strap is described in document WO 97/28859. These straps include two parts, namely a first part formed by a rectilinear notched tongue which is fixed on one side of the binding and, on the other side of the binding, the strap comprises a part which passes over the foot, ending in a pawl system.

More precisely, the rectilinear tongue is placed between the walls of a guide on which a pawl is articulated. This pawl interacts with the notches of the notched tongue in order to prevent the strap from loosening. The walls of the guide are separated by a distance equal to the width of the notched tongue, in order to prevent any mechanical play and to prevent the notched tongue from being displaced laterally in the guide.

This need to limit the mechanical play of the tongue inside the guide thus leads to it being necessary to have a tongue of the same width as the guide. In point of fact, this arrangement does not facilitate the insertion of the tongue into the guide, since it is necessary for the user to adjust the tongue very precisely when he wishes to push it into the guide. These operations are all the more awkward because the user is generally wearing gloves, which makes him less precise in his movements.

A problem that the invention thus proposes to solve is that of making the absence of lateral play of the tongue inside the guide compatible with ease of positioning the tongue in the guide.

A solution to this problem has already been proposed, as illustrated in document FR 2 758 057. Thus, the tongue used on the binding described in that document has an end cut in the shape of a triangle, thus being narrower at its end which is the first to come into contact with the guide. This solution offers limited efficiency, since it is important for the pointed part of the tongue to be inserted into the width of the guide so that the centring effect can take place. Moreover, such a solution is all the more effective when the tongue is cut into a point and when it thus has an acute angle which possibly risks causing injury. This tongue is also relatively fragile.

SUMMARY OF THE INVENTION

The invention thus relates to a device for clamping together two parts of a sports article.

Such a device includes, in a known manner:

- a rectilinear notched tongue, integral with a first part of the sports article;
- a guide integral with the second part of the sports article, said guide having two walls between which said tongue is able to slide;
- a pawl articulated on the guide, capable of interacting with the notched tongue in order to immobilize it in position relative to the guide.

According to the invention, the device is characterized in that it also includes a complementary piece interacting with at least one part of the outer faces of the guide, and of which the portion located on the side with the opening of the guide via which the tongue is inserted includes two divergent walls which flare out and extend beyond the opening of the guide.

In other words, the device which immobilizes the tongue includes a centring piece of which a part forms an opening for the insertion of the tongue, markedly wider than the opening of the actual guide. In this way, when the user brings the tongue close to the characteristic piece, even if the tongue is not perfectly in line with the axis of the guide, its end comes into contact with the characteristic divergent walls. The tongue is thus recentred and guided as far as the entry to the guide, in which it is positioned without lateral play.

Thus, irrespective of the shape of the end of the tongue, the tongue is successfully inserted into the guide more easily and more rapidly.

In a particular embodiment, the guide is nested in the complementary piece, the divergent walls of which extend via lateral walls opposite the walls of the guide. In other words, the complementary piece surrounds the underneath of the guide and covers over the lateral faces of the latter. This complementary piece may, for example, be produced by overmoulding on the guide, which may be metallic.

In this way, raising of the guide inside the complementary piece is prevented.

Thus, the guide is properly held inside the complementary piece. This holding may be further improved by using centring means provided on the guide and the complementary piece.

These centring means may, for example, be formed by a stud and a corresponding aperture which are located on the guide and on the complementary piece.

In this way, any longitudinal displacement of the guide inside the complementary piece is prevented.

This immobilizing of the guide relative to the complementary piece may be further improved if the walls of the guide extend via divergent walls in contact with a part of the inner faces of the divergent walls of the complementary piece. In other words, close to the opening of the guide, the parallel lateral walls of the latter may flare out slightly and nest partially in the divergent walls of the complementary piece. In this configuration, any relative movement of the guide and the complementary piece is prevented.

Advantageously, in practice, the lateral walls of the complementary piece may form zones for gripping the guide. In other words, the movements of the pawl and of the other movable pieces associated with the guide may be facilitated by efficient gripping of the complementary piece and thus of the guide. The outer faces of the lateral walls of the complementary piece are therefore configured ergonomically in order to allow the user's fingers to take hold.

In a particular embodiment, the two lateral walls of the complementary piece are asymmetrical. In other words, the two gripping zones present on either side of the guide are not located at the same longitudinal level of the complementary piece, but are, on the contrary, offset, in order to adapt to the difference in length between a thumb and forefinger. The gripping zone for receiving the pressure of the forefinger is located closer to the opening of the guide than that for receiving the pressure of the thumb.

Various pieces may be fitted onto the guide to ensure various types of interaction with a tongue. Thus, the guide may include a lever interacting with the tongue in order to cause the latter to advance in the guide. In other words, when actuated, this supplementary lever pushes the tongue back inside the guide, thereby increasing the clamping effect. The pawl, moreover, immobilizes the tongue, not opposing its advance into the guide but preventing its withdrawal.

In other embodiments, the tongue is associated with an articulated buckle which is integral with the tongue and which ensures the displacement of the latter inside the guide when actuated by the user. In other words, the movement of this articulated buckle gives rise to the displacement of the tongue in the direction of insertion, which enables it to penetrate the guide and to interact with the pawl. When the user folds the buckle back or, more generally, moves it, he exerts a pulling action on the tongue in the opposite direction from its insertion into the guide. This movement is thwarted by the pawl, which ensures clamping.

The reverse arrangement may also be adopted. In this case, the guide and the pawl are associated with a buckle. Movement of the buckle displaces the guide and the complementary piece towards the tongue, which is fixed.

The characteristic, complementary piece of the invention may form an integral part of a new-concept immobilizing system, or alternatively, be added under the guide of an existing system, so as to improve the functioning of the latter.

The clamping device according to the invention may be applied particularly advantageously as equipment for snowboard bindings. In this case, the device is fitted to clamp together the two parts of a strap.

The device according to the invention may also be fitted onto a gliding-sport boot, such as a downhill ski boot, a cross-country ski boot, a snowboard boot or the like, and even to a roller skate or an ice skate. In this case, the device is used to clamp together two flaps of the boot, a first flap carrying the tongue, the other flap carrying the guide and the characteristic complementary piece.

BRIEF DESCRIPTION OF THE FIGURES

The way in which the invention is implemented and also the advantageous arising therefrom will become clearly apparent from the description of the following embodiments, supporting the appended figures in which.

IMPLEMENTATION OF THE INVENTION

As already stated, the invention relates to a clamping device which can be applied most particularly to gliding sports and, notably, to ski boots and snowboard bindings.

Figure 1:
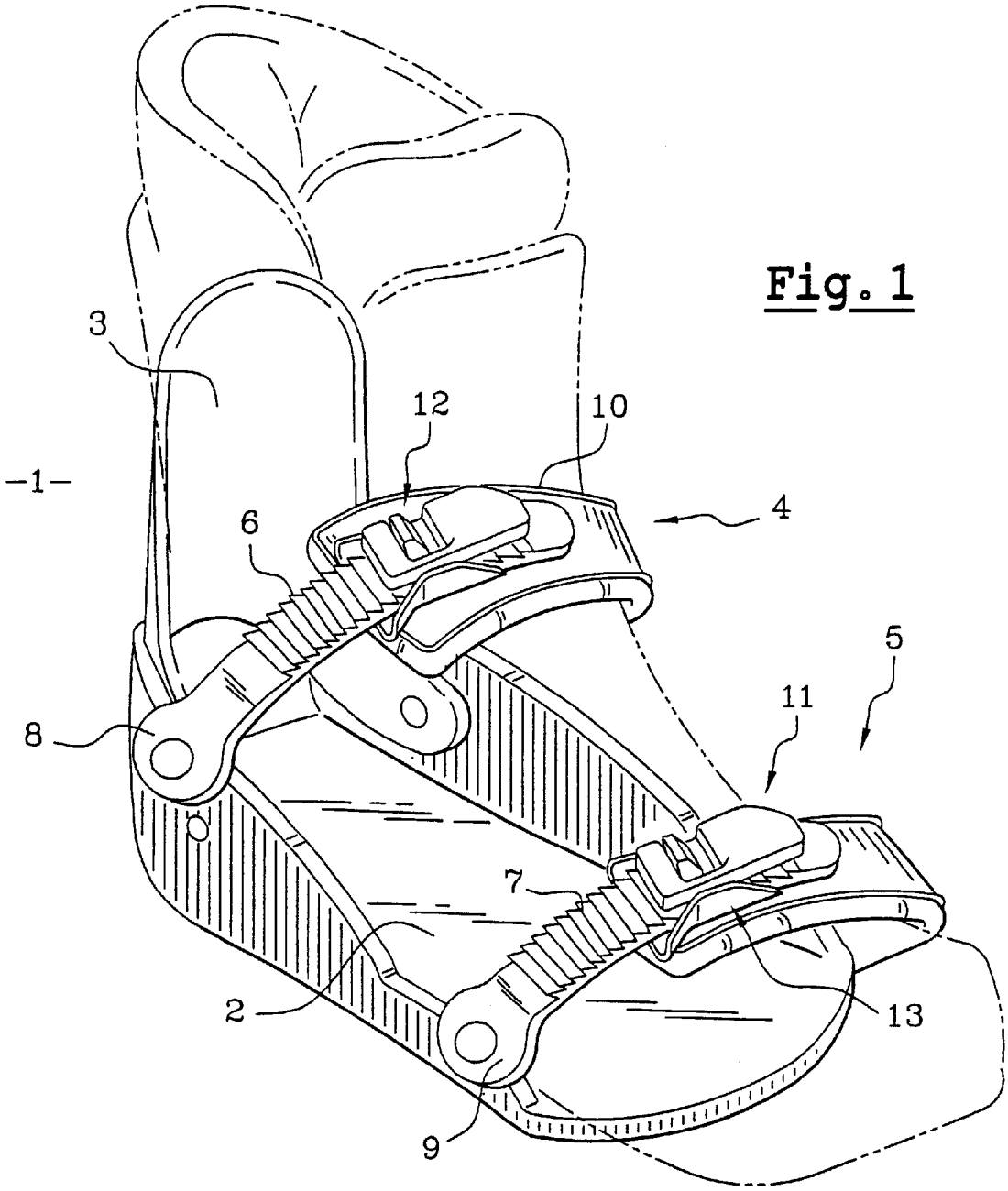
FIG. 1 is a brief perspective view of a binding equipped with the immobilizing device.

In its application to snowboard bindings, as illustrated in FIG. 1, the invention makes it possible to equip a binding (1) of the "shell" type which comprises a base (2), a rear shell (3) and two straps (4, 5) which connect the two sides of the base (2), passing, respectively, over the instep and over the metatarsophalangeal joint.

Each of these straps (4, 5) comprises a rectilinear notched tongue (6, 7) which is secured by one end (8, 9) to one side of the base. The other part (10, 11) of the strap is secured to the other side of the base. This part (10, 11), which passes over the boot, is generally wider and padded in order to distribute the pressure it exerts on the boot and to prevent it injuring the user. In its end portion, this part (10, 11) of the strap comprises a clamping mechanism (12, 13) produced in accordance with the invention. This clamping device (12, 13) may have various designs, as illustrated in FIG. 1. Generally speaking, these immobilizing mechanisms (12, 13) comprise a guide, in which the notched tongue (6, 7) slides, and a pawl system which interacts with the tongue (6, 7) to prevent the latter's sliding inside the guide in a direction which would loosen the strap.

Figure 2:
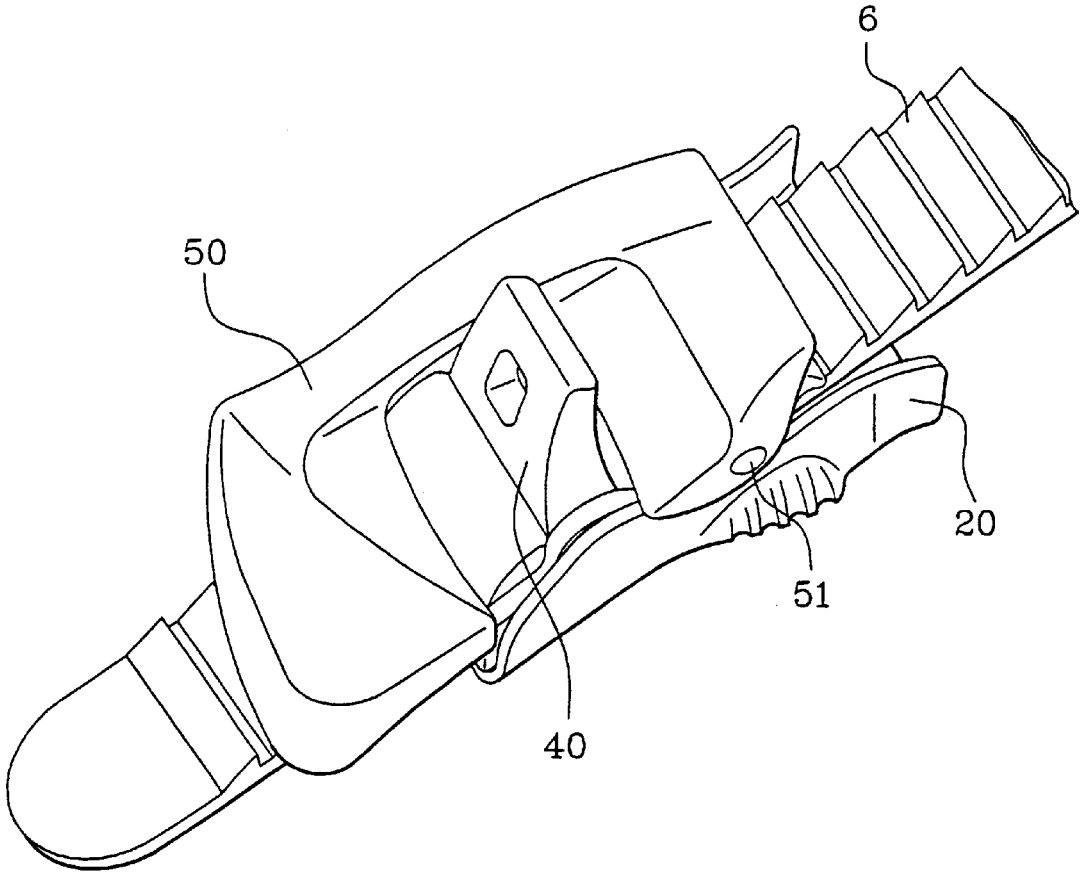
FIG. 2 is a brief perspective view of the immobilizing zone of the clamping device.

In a more improved embodiment, as illustrated in FIG. 2, the clamping mechanism also comprises a lever (50) which interacts with the tongue (6) to cause the latter to advance inside the guide, in the clamping direction. This additional lever (50), which may be advantageous, is, however, not necessary for implementation of the invention.

Figure 3:
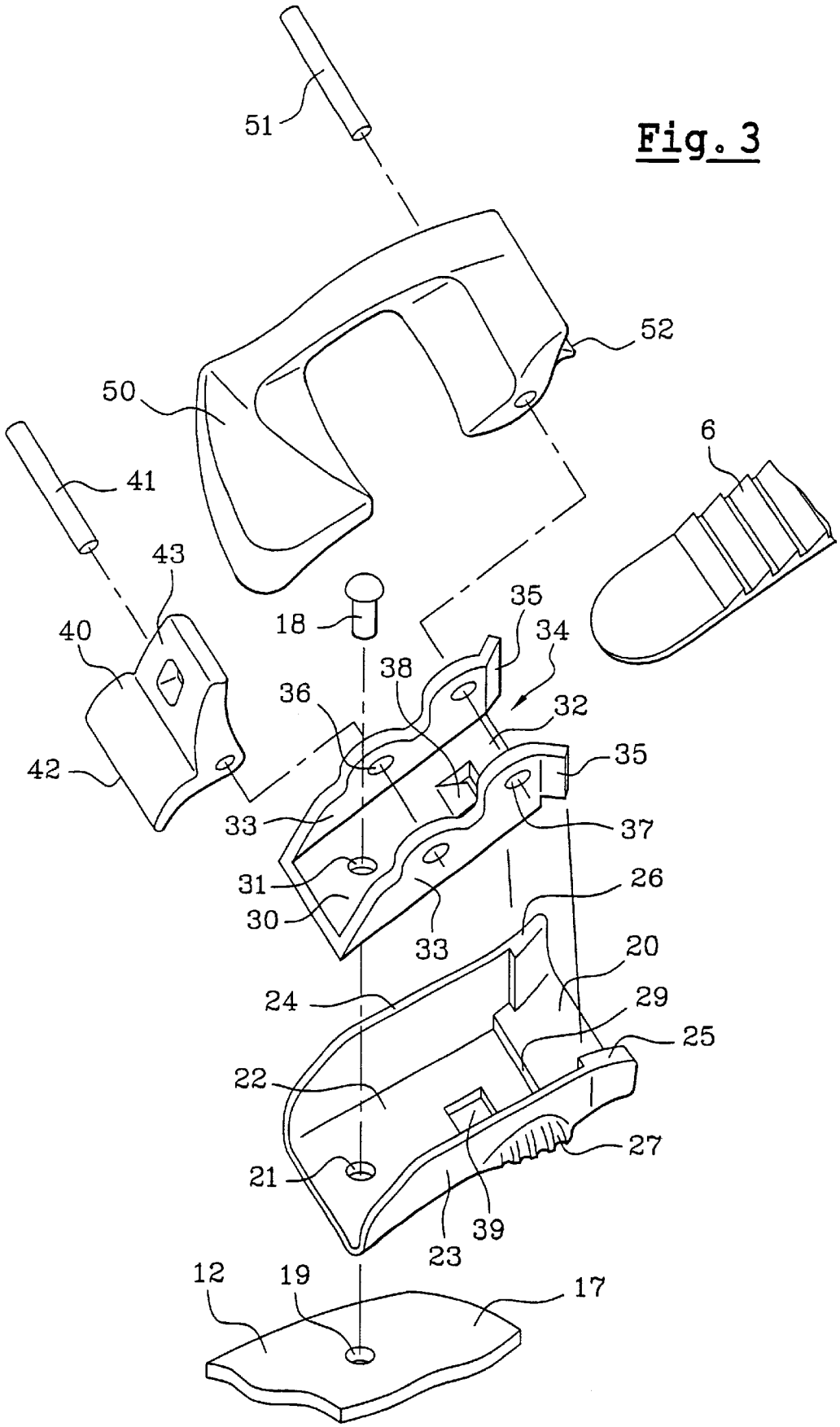
FIG. 3 is an exploded view showing the various elements illustrated in FIG. 2, in a distinct manner.
Figure 4:
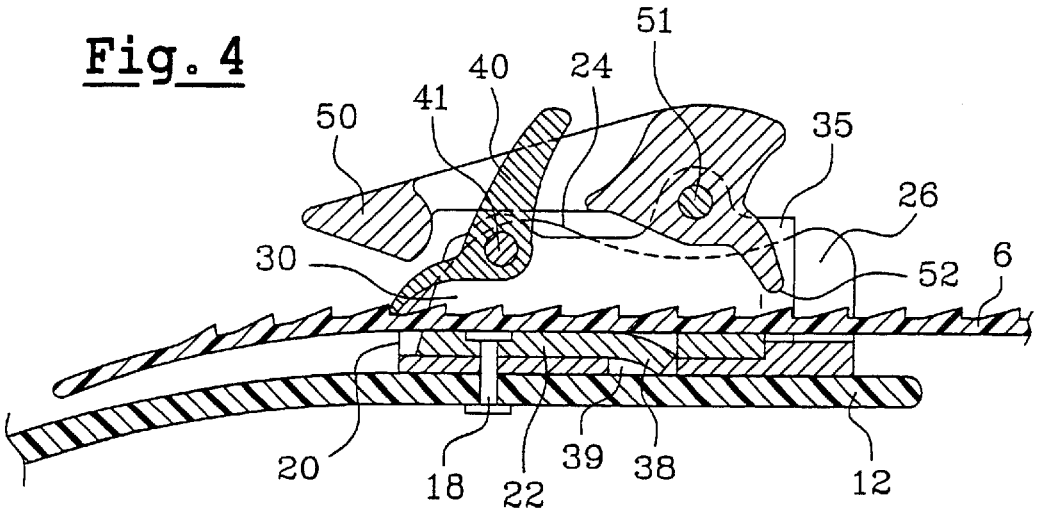
FIG. 4 is a view in longitudinal section of the immobilizing mechanism of FIG. 3.

The various elements which form the clamping mechanism are illustrated separately in FIG. 3. Thus, the assembly formed by the complementary piece (20), the guide (30), the pawl (40) and the clamping lever (50) is secured at the end (17) of the strap (12). This securing may, for example, be achieved by a rivet (18) passing through a hole (31) made in the guide (30) and a hole (21) formed in the central part (22) of the complementary piece (20) and also a hole (19) made in the strap (12).

The complementary piece (20) comprises a central part (22), and two lateral walls (23, 24) located on either side of the central part (22). These lateral walls (23, 24) extend at the front via divergent walls (25, 26) which flare out, distancing themselves from the body of the piece (20). On each outer face of the lateral walls (23, 24), the complementary piece (20) includes a gripping zone (27, 28) which protrudes slightly. The shape of these gripping zones is determined by ergonomic considerations. One of the two gripping zones (27, 28) may be offset longitudinally relative to the other in order to take into account the difference in positioning of the thumb and forefinger when the piece (20) is grasped by the user.

As illustrated in FIG. 3, the central part (22) of the complementary piece (20) comprises a light reinforcement, delimited by the excess thickness (29), inside which the guide (30) nests. The guide (30) also comprises a central zone (32) which takes up its position in the reinforcement of the complementary piece (20). On each side, the guide (30) comprises lateral walls (33) which are flat and parallel. Close to the opening (34) of the guide, these lateral walls (33) have an extension (35) which flares out from the lateral wall (33) towards the outside. These extension portions (35)

nest in a part of the divergent walls (25, 26) of the complementary piece (20). The two lateral walls (33) of the guides (30) are each pierced with a pair of openings (36, 37) which receive the pins (41, 51), respectively, of the pawl (40) and of the lever (50).

In its central part, the guide (30) includes a cutout which makes it possible to form a stud (38) which is deformed downwards, in order to nest in an opening (39) provided for this purpose in the complementary piece (20). In this way, centring and immobilizing of the guide (30) inside the complementary piece (20) are assured.

As illustrated in FIG. 3, the guide (30) thus receives the pawl (40) immobilizing the tongue (6) inside the guide (30). To this end, the pawl (40) has a ridge (42) which nests in a notch in the tongue (6). Pressure on the pressure zone (43) of the pawl (40) pivots the latter and releases the ridge (42) from the notch in the tongue (6). This manoeuvre thus loosens the strap.

Conversely, clamping is achieved by manoeuvring the lever (50). When this lever (50) is raised, its ridge (52) comes into contact with a notch in the tongue (6), pushing the notch back in the direction of advance inside the guide (30).

Figure 5:
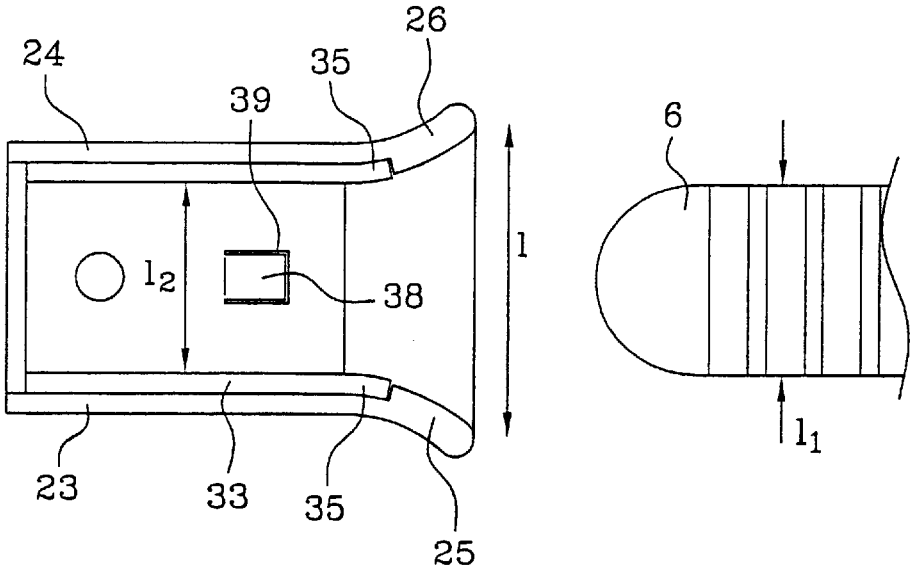
FIG. 5 is a top view showing the guide and the complementary piece.

As illustrated in FIG. 5, the width $l_1$ of the tongue is substantially equal to the distance ($l_2$) separating the inner faces of the walls (33) of the guide (30). In this way, the tongue is guided practically without any transverse play and thus no lack of precision in clamping. On the other hand, the width L of the complementary piece, measured in the region of its opening, between the divergent walls (25, 26), is markedly greater than the width $l_1$ of the tongue (6) so that, even if the tongue is not presented in the axis of the guide (30), the latter is automatically deflected in the right direction by the characteristic divergent walls (25, 26).

The invention is not limited to the use of a lever causing the tongue to advance inside the immobilizing mechanism, but also covers other variants in which the guide (30) and the complementary piece (20) include only one immobilizing pawl.

Figure 6:
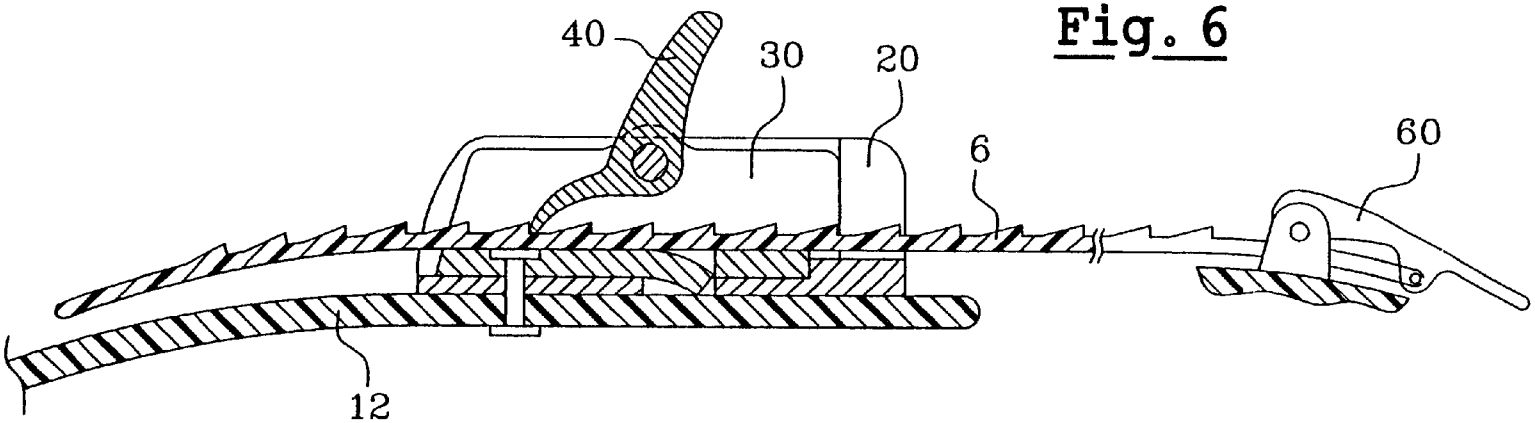
FIGS. 6 and 7 are longitudinal sectional views of the tongue of the immobilizing mechanism shown in the case of two variant embodiments.

In this case, the advance of the tongue may be caused in different ways. Thus, as illustrated in FIG. 6, the tongue (6) may be associated with an articulated buckle (60), located at its end connecting it to the base of the binding. Manoeuvring the buckle (60) causes the tongue (6) to lengthen and to be inserted inside the guide (30). Manoeuvring of the buckle (60) in the opposite direction gives rise to a pulling action on the tongue and thus on the whole guide and complementary piece when the pawl comes back into action.

Figure 7:
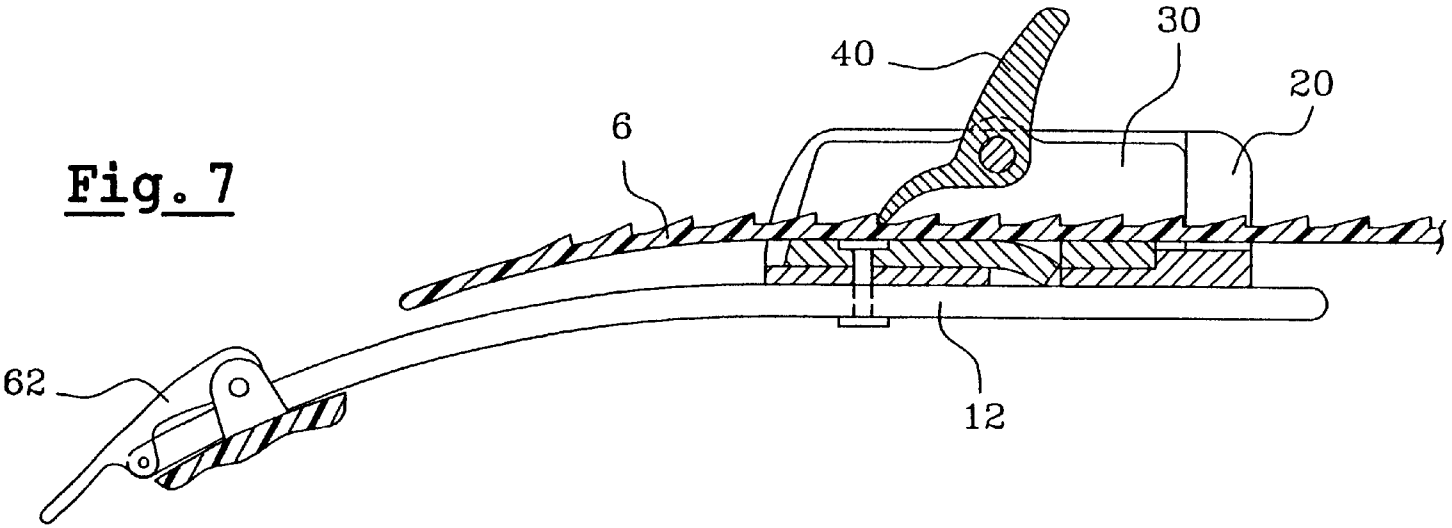

In another embodiment, illustrated in FIG. 7, it is the strap (12) which supports the guide (30) and the complementary piece (20) which is associated with a deformable buckle (62). In this case, when this buckle (62) is manoeuvred, the guide (30) and the complementary piece (20) are displaced towards the tongue (6), causing the latter to penetrate the guide (30). Manoeuvring the buckle in the opposite direction pulls on the strap (12) and thus on the guide (30) and the pawl (40). When the latter comes into action again, it thus pulls on the tongue (6) and therefore clamps the strap.

Figure 8:
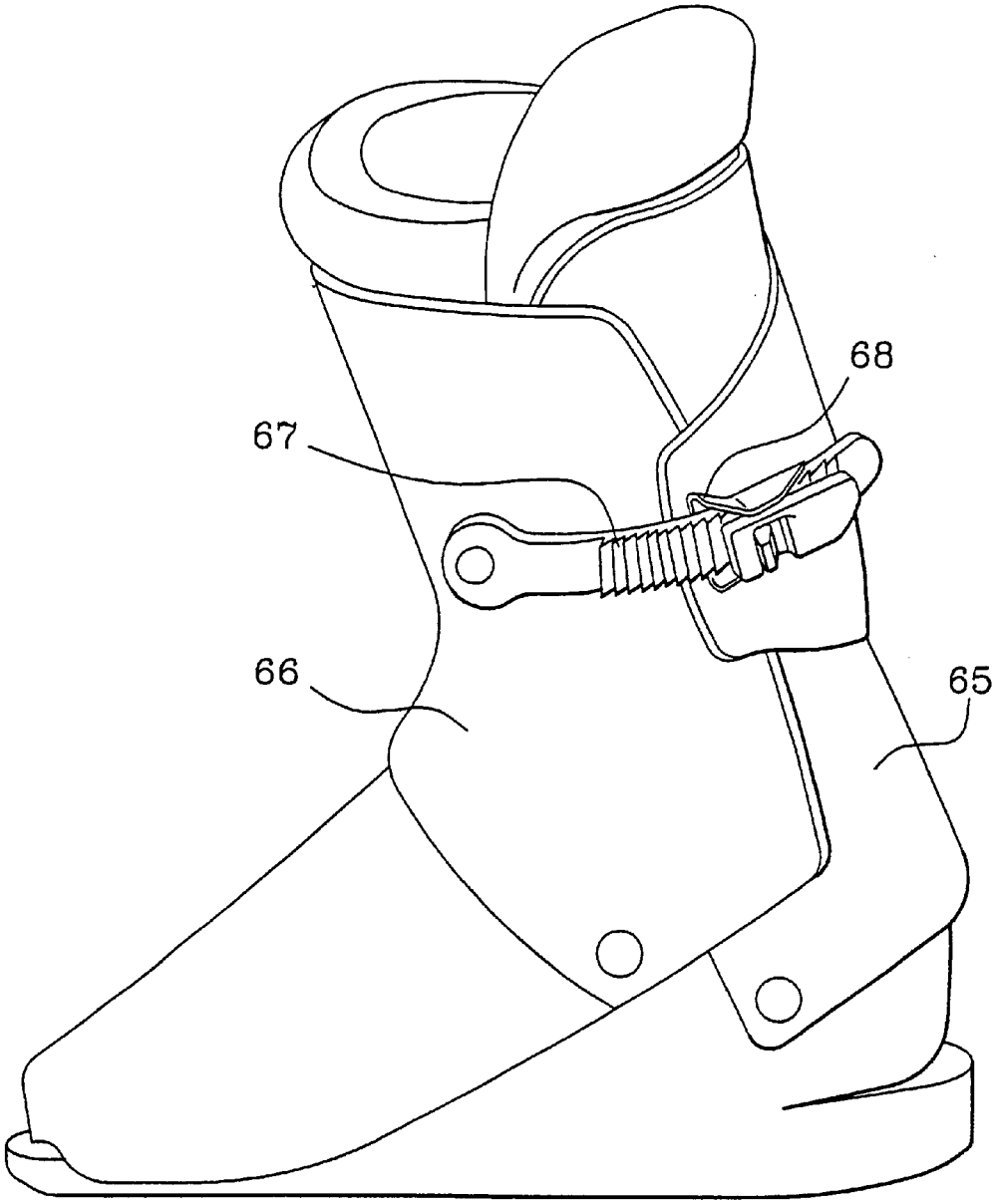
FIG. 8 is a brief perspective view of a ski boot equipped with a variant embodiment of clamping device.

The invention may also be used on ski boots or the like, as illustrated in FIG. 8. In this case, the clamping device connects the front (66) and rear (65) flaps of a boot. In the embodiment illustrated, the tongue (67) is secured to the front flap (66) and the rear flap (65) includes the immobilizing mechanism. The latter is equipped with the characteristic piece (68) facilitating insertion of the tongue (67) in the immobilizing mechanism.

It emerges from the aforesaid that the use of the clamping means described above offers a number of advantages, and, in particular:

- guaranteed correct insertion of the tongue in the immobilizing guide, even when the tongue is not placed precisely in the axis of the guide, for example when the user lacks some of the required precision on account of his gloves;
- easier and faster positioning;
- the possibility of adapting the characteristic complementary piece to certain existing buckles.

Industrial Applications

The clamping device according to the invention may, as already stated, be used for a number of applications and, in particular, in gliding sports for snowboard bindings, downhill ski boots, cross-country ski boots or the like, and also snowboard boots.

It may also be used as a clamping means for harnesses or the like, or, alternatively, for sports bags.

What is claimed is:

1. Device for clamping together two parts of a sports article, said device comprising:

- a rectilinear notched tongue (6), integral with a first part of the sports article;
- a guide (30) integral with a second part of the sports article, said guide having an opening side for receiving said tongue and two walls (33) between which said tongue (6) is able to slide;
- a pawl (40) articulated on the guide (30), said pawl configured to interact with the notched tongue (6) in order to immobilize it in position relative to the guide (30); and
- a complementary piece (20) for interacting with at least one part of the outer faces of the guide (30), said complementary piece comprising two divergent walls which flare out and extend beyond said guide on said opening side of said guide.

2. Device according to claim 1, characterized in that the guide (30) is nested in the complementary piece (20), the divergent walls (25, 26) of which extend via lateral walls (23, 24) opposite the walls (33) of the guide (30).

3. Snowboard binding equipped with at least one clamping device according to claim 2, wherein the two parts to be clamped together are the parts of a clamping strap (4,5).

4. Gliding-sport boot equipped with at least one device according to claim 2, wherein the two parts to be clamped together are two flaps (66, 65) of the boot, one (66) of which carries the tongue (67) and the other the guide and the complementary piece (68).

5. Device according to claim 2, characterized in that it includes means for centring the guide (30) relative to the complementary piece (20).

6. Snowboard binding equipped with at least one clamping device according to claim 5, wherein the two parts to be clamped together are the parts of a clamping strap (4,5).

7. Gliding-sport boot equipped with at least one device according to claim 5, wherein the two parts to be clamped together are two flaps (66, 65) of the boot, one (66) of which carries the tongue (67) and the other the guide and the complementary piece (68).

8. Device according to claim 5, characterized in that the centring means are formed by a stud (38) and a corresponding aperture (39) which are located on the guide (30) and on the complementary piece (20).

9. Snowboard binding equipped with at least one clamping device according to claim 8, wherein the two parts to be clamped together are the parts of a clamping strap (4,5).

10. Gliding-sport boot equipped with at least one device according to claim 8, wherein the two parts to be clamped together are two flaps (66, 65) of the boot, one (66) of which carries the tongue (67) and the other the guide and the complementary piece (68).

11. Device according to claim 2, characterized in that the walls (33) of the guide extend via divergent walls (35) in contact with a part of the inner faces of the divergent walls (25, 26) of the complementary piece (20).

12. Snowboard binding equipped with at least one clamping device according to claim 11, wherein the two parts to be clamped together are the parts of a clamping strap (4,5).

13. Gliding-sport boot equipped with at least one device according to claim 11, wherein the two parts to be clamped together are two flaps (66, 65) of the boot, one (66) of which carries the tongue (67) and the other the guide and the complementary piece (68).

14. Device according to claim 2, characterized in that the lateral walls (23, 24) of the complementary piece form zones (27, 28) for gripping the guide (30).

15. Device according to claim 14, characterized in that the two lateral walls (27, 28) of the complementary piece are asymmetrical.

16. Device according to claim 1, characterized in that the guide (30) includes a lever (50) interacting with the tongue (6) in order to cause the latter to advance in the guide (30).

17. Device according to claim 1, characterized in that it includes an articulated buckle (60) integral with the tongue (6) and ensuring the displacement of the tongue (6) inside the guide (30).

18. Device according to claim 1, characterized in that it includes an articulated buckle (62) integral with the guide (30) and with the complementary piece (20) and ensuring the displacement of the guide (30) relative to the tongue (6).

19. Snowboard binding equipped with at least one clamping device according to claim 1, wherein the two parts to be clamped together are the parts of a clamping strap (4, 5).

20. Gliding-sport boot equipped with at least one device according to claim 1, wherein the two parts to be clamped together are two flaps (66, 65) of the boot, one (66) of which carries the tongue (67) and the other the guide and the complementary piece (68).

* * * * *